US005348070A

United States Patent [19]

Fischer et al.

[11] Patent Number: 5,348,070

[45] Date of Patent: Sep. 20, 1994

[54] PROCESS FOR THE COMPRESSION OF MOLDING SAND FOR CASTING MOLDS

[75] Inventors: Kurt Fischer; Hans Leutwiler, both of Schaffhausen, Switzerland

[73] Assignee: Georg Fischer AG, Schaffhausen, Switzerland

[21] Appl. No.: 27,359

[22] Filed: Mar. 8, 1993

[30] Foreign Application Priority Data

Mar. 10, 1992 [CH] Switzerland ..... 759/92

[51] Int. Cl.[5] ..... B22C 15/28

[52] U.S. Cl. ..... 164/38; 164/37

[58] Field of Search ..... 164/37, 38, 169, 172, 164/173, 195, 456

[56] References Cited

U.S. PATENT DOCUMENTS

| | | | |
|---|---|---|---|
| 4,415,015 | 11/1983 | Zadera . | |
| 4,529,026 | 7/1985 | Köbel et al. | 164/37 |
| 4,546,810 | 10/1985 | Landolt | 164/37 |
| 4,598,756 | 7/1986 | Fuchigami et al. | 164/37 |
| 4,617,978 | 10/1986 | Damm | 164/37 |
| 4,619,307 | 10/1986 | Müller et al. | 164/37 |
| 4,828,007 | 5/1989 | Fischer et al. | 164/37 |
| 4,846,253 | 7/1989 | Damm | 164/37 |
| 4,915,159 | 4/1990 | Damm et al. | 164/456 |
| 4,921,035 | 5/1990 | Leutwiler | 164/37 |
| 5,020,582 | 6/1991 | Damm et al. . | |
| 5,161,596 | 11/1992 | Fischer et al. | 164/38 |

FOREIGN PATENT DOCUMENTS

| | | | |
|---|---|---|---|
| 3839475 | 5/1990 | Fed. Rep. of Germany . | |
| 0141355 | 11/1980 | Japan | 164/37 |
| 1269286 | 4/1972 | United Kingdom | 164/37 |
| 2127726 | 4/1984 | United Kingdom | 164/37 |
| 2163686 | 3/1986 | United Kingdom | 164/37 |

*Primary Examiner*—P. Austin Bradley
*Assistant Examiner*—Erik R. Puknys
*Attorney, Agent, or Firm*—Bachman & LaPointe

[57] ABSTRACT

The invention relates to a process for the compression of molding sand in casting molds having a pattern plate with a pattern arranged therein. The molding sand is introduced loosely into the molding space located above the pattern plate and is thereafter fluidized to a final pressure of 20 bar maximum by means of a compressed-air surge acting on the molding sand followed by compression, by mechanical pressing. The process of the present invention provides a smooth pressure surge which is subdivided into at least a two part gradient in its pressure-rise time curve, so that the first part of the pressure-rise gradient takes place from 0.3 to 18 bar/sec to a pressure $P_1$ and the second part has an increased pressure-rise gradient which takes place from 18 to 95 bar/sec. to a pressure $P_2$ where $P_1 < P_2 \leqq 20$ bar. Subsequently, the $P_2$ pressure is reduced in an essentially controlled manner, with a pressure-reduction gradient of a minimum of 3 bar/sec., and the pressing operation is initiated during the controlled pressure reduction.

5 Claims, 1 Drawing Sheet

PROCESS FOR THE COMPRESSION OF MOLDING SAND FOR CASTING MOLDS

BACKGROUND OF THE INVENTION

The present invention relates to a process for compressing molding sand in a molding operation and, more particularly, a process for the effective compression of molding sand about complex, deep pocketed casting patterns.

European Patent Specification 0,022,808 discloses a process wherein molding sand which is introduced loosely into the molding space is precompressed by means of a pressure shock and thereafter post-compressed mechanically. The specific pressure required in the process and how they are applied by the pressure surge are not disclosed.

It is known from German Offenlegungsschrift 3,836,876 to compress with a single pressure shock which has a first low and then a second high pressure gradient (30 to 100 bar/sec. until approximately 1 to 3 bar is reached, and thereafter 100 to 600 bar/sec. until approximately 3 to 6 bar is reached). The pressure shock is applied so as to result final compression of the molding sand.

It is further known from U.S. Pat. No. 4,828,007 to compress with two pressure shocks, the first having a lower (up to a maximum of 40 bar/sec. ) pressure gradient than the second (up to 300 bar/sec.) at a maximum pressure of up to 20 bar, wherein a controlled pressure reduction taking place between the two pressure shocks in order to achieve a curve of dimensional stability decreasing towards the mold back.

DE 3,839,475 discloses a process for the compression of molding sands, containing binding clays, in a molding device, in which, before the pulse compression, some of the molding sand located in the molding frame, and particularly its increased packing density, is displaced towards the pulse generator counter to the effective direction of the pulse compression.

The displacement can be achieved in that, after the molding sand has been introduced into the molding chamber, gas, especially air, is introduced under pressure into the closed-off molding chamber and, as a result of the opening of at least one outlet orifice located in the wall of the molding chamber in the vicinity of the pulse generator, the gas contained within the molding sand introduced is expanded towards the outlet orifice and the molding sand is thus displaced towards the outlet orifice and therefore towards the pulse generator.

The foregoing process makes it possible to obtain in the molding chamber a distribution of the molding sand introduced which has a packing density which is low near the pattern and rises at an increasing distance from the pattern. Both the accelerating mass and the path available for the acceleration are therefore increased. At the same pulse intensity or the same acceleration, the speed of the mass striking the model device thereby increases, thus leading to a high impact force of the compression front during the pulse compression.

It is the principle object of the invention to provide a process for compressing molding sand wherein complicated casting patterns having deep pockets or the like can be better shaped and a more uniform compression can be achieved even in the more complicated and critical parts of the pattern, while, at the same time, ensuring favorable cycle times.

SUMMARY OF THE INVENTION

The foregoing object is achieved by the process of the present invention wherein a pressure surge is used which is subdivided into at least a two part gradient in its pressure-rise time curve, such that the first part of the pressure-rise gradient takes place from 0.3 to 18 bar/sec. to a pressure $P_1$ and the second part has an increased pressure-rise gradient which takes place from 18 to 95 bar/sec. to a pressure $P_2$ where $P_1 < P_2 \leqq 20$ bar. Thereafter the pressure $P_2$ is reduced in an essentially controlled manner, with pressure-reduction gradients of a minimum of 3 bar/sec. wherein a mechanical pressing operation is initiated during the controlled pressure reduction.

BRIEF DESCRIPTION OF THE DRAWING

The FIGURE is a partial cross sectional schematic illustration of a molding apparatus useful for carrying out the process of the present invention.

DETAILED DESCRIPTION

Figure 1:
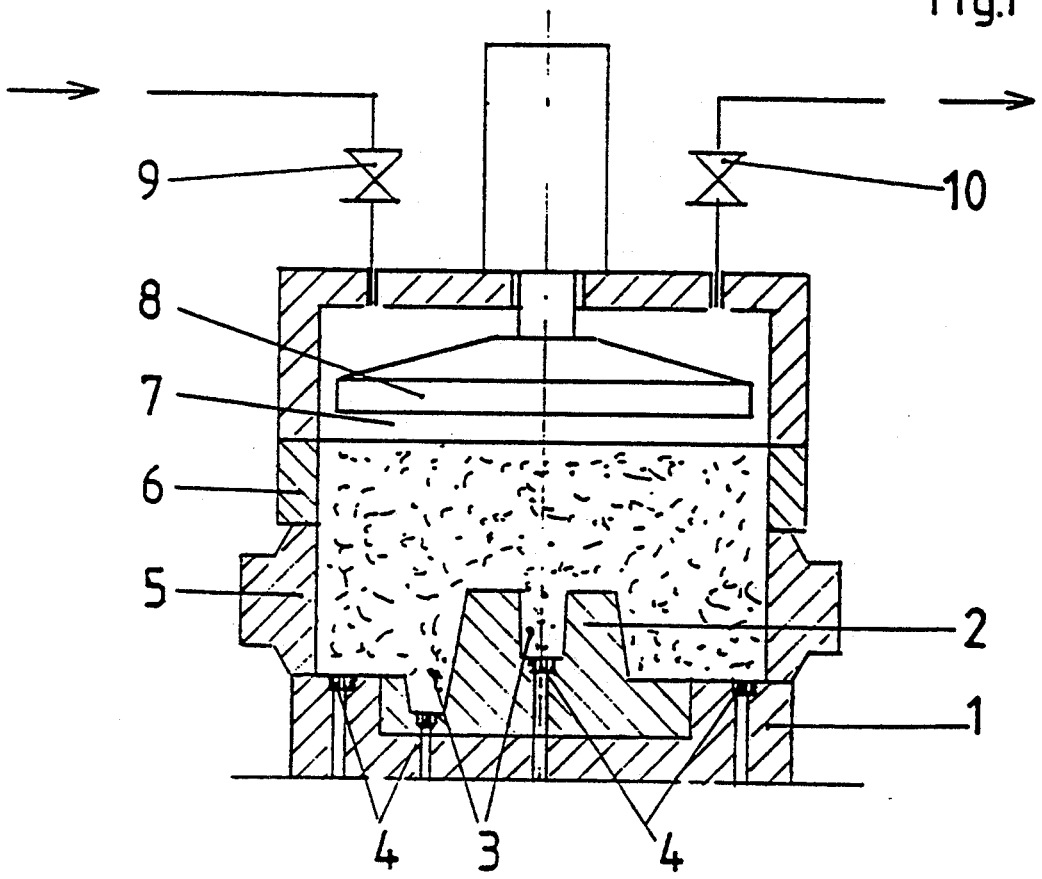

The process of the present invention is explained in more detail below with reference to the FIGURE.

A molding apparatus useful for carrying out the process of the present invention comprises a pattern plate 1 having a casting pattern 2 located on it which can, for example, have one or more deep pockets 3. The pattern plate 1 and, if appropriate, the pattern 2, the latter approximately in the region of a pocket 3, can be provided with nozzles 4 which are located especially adjacent to the pattern 2 or also additionally adjacent to the inner wall of a molding box 5 removably standing on the model plate 1. A filling container 6 is located above the molding box 5. The molding space 7 thereby formed, after being filled loosely with a predetermined quantity of molding sand, is closed off by means of a press plate 8 movable in the direction of the pattern plate 1. The molding space 7 can be loaded with compressed air via a valve 9 and can be bled by means of a valve 10.

The process of the present invention comprises applying a pressure surge to the sand in the molding box wherein the pressure surge is applied in at least a two part pressure-rise gradient. The first part of the pressure-rise gradient takes place from 0.3 to 18 bar/sec. to a pressure $P_1$. The pressure-rise gradient is then increased to a second pressure-rise gradient of about 18 bar/sec. to 95 bar/sec. to produce a second pressure $P_2$ wherein $P_1 < P_2 \leqq 20$ bar. Thereafter, the pressure $P_2$ is reduced in a controlled manner at a pressure-reduction gradient of at least 2 bar/sec. and a mechanical press of the molding sand is initiated during the controlled pressure reduction.

As a result of the pressure surge applied by the at least two part pressure-rise gradient, time curve used in the process of the present invention, a smooth pressure build-up in the molding sand is achieved which is initially only relatively weak and then becomes somewhat stronger. When the predetermined pressure head is reached in the molding space, a controlled mold bleeding is carried out. This takes place above the sand surface out of the free-space volume. Under the effect of the pressure drop, the molding sand is fluidized, that is, the flowability of the sand is improved from the pattern plate in the direction of the mold back, in such a way that, during the mechanical pressing operation, the molding sand can be uniformally compressed.

An advantage of the process is that, as a result of the controlled expansion of the gas in the molding sand, a simultaneous pressure reduction takes place in the entire mold, and that the entire sand volume is thereby fluidized. A uniform fluidization through the pattern plate is only impossible for practical reasons, since pattern devices cannot be designed with a surface-covering air-discharge system, such as, for example, slit nozzles or the like.

It has been found that, for an efficient fluidization of the mold sand (1) the pressure build-up in the molding sand must take place smoothly so as to prevent a precompression and (2) the subsequent pressure reduction must take place with a pressure gradient of a minimum of 3 bar/sec. in order to obtain a uniform compression during the mechanical pressure operation. The optimum value is dependent on the molding material; that is, a molding material having low gas permeability requires a lower pressure-reduction gradient than a molding material with higher gas permeability. The special two part pressure-rise gradient time curve can be justified as follows: if the pressure build-up in the molding space is carried out with a constant low pressure gradient, a substantially longer period of time than when a stepped pressure-rise gradient is used is required. In order to prevent precompression of the molding sand during the pressure build-up, it is important, above all, that a relatively flat gradient be used in the initial phase, that is to say at least in the first part of the pressure rise.

An increased pressure-rise gradient can then be used in the second part of the pressure rise, without adverse precompression being obtained.

The shortest cycle times are achieved with a continuously increasing pressure-rise gradient.

Where patterns with especially deep pockets are concerned, it can be expedient to expand some of the compressed gas out of the molding space, also through the model device, by means of nozzles in the regions where molding is difficult.

The process of the present invention therefore necessitates interaction between the pressure build-up and pressure reduction, in order to obtain optimum compression results. One the one hand, too steep a pressure build-up gradient leads to undesirable precompression, and on the other hand too slow a pressure-reduction gradient results in a weak fluidization of the molding material, thus leading to non-uniform dimensional stabilities during the mechanical post-compression.

The process is especially suitable for small compact molding machines, since the work can be carried out with compressed air from the conventionally present compressed-air system which provides compressed air of approximately 6 to 7 bar, and therefore there is no need for an additional compressor unit.

The mechanical pressing is preferably carried out in such a way that essentially a pressure loading of the surface of the molding sand which is uniform everywhere is achieved. This is accomplished by employing a flexible press plate or of a multiplicity of individual press rams, since this is advantageous for uniform compression, particularly also in the region of deep pockets and tall models.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for compressing molding sand in a molding apparatus having a pattern plate, a casting pattern arranged on the pattern plate and a molding box mounted on the pattern plate so as to define therewith a molding space around the pattern, the process comprising the steps of:

(a) providing a source of compressed air;

(b) feeding molding sand into the molding space such that the molding sand covers the casting pattern thereby forming a surface layer of the molding sand on the pattern plate;

(c) precompacting the molding sand on the pattern plate by (1) applying a surge of compressed air to the molding sand at a first pressure-rise gradient of between 0.3 bar/sec. to 18 bar/sec. to produce a first pressure $P_1$ and thereafter (2) increasing the first pressure-rise gradient to a second pressure-rise gradient of between 18 bar/sec. to 95 bar/sec. to produce a second pressure $P_2$ where $P_1 < P_2 \leqq 20$ bar; and (d) final compacting the molding sand on the pattern plate by mechanically pressing the molding sand while reducing the pressure $P_2$ in a controlled manner at a pressure-reduction gradient of at least 3 bar/sec.

2. A process according to claim 1 including mechanically pressing the molding sand so as to provide a substantially uniform pressure loading of the surface layer of the molding sand.

3. A process according to claim 2 including mechanically pressing the molding sand with a flexible plate.

4. A process according to claim 2 including mechanically pressing the molding sand with individual press rams.

5. A process according to claim 1 including linearly reducing the pressure $P_2$.

* * * * *